US008765983B2

(12) United States Patent
Fleischer et al.

(10) Patent No.: US 8,765,983 B2
(45) **Date of Patent: *Jul. 1, 2014**

(54) SYSTEMS AND METHODS FOR EXTRACTING LIPIDS FROM AND DEHYDRATING WET ALGAL BIOMASS

(75) Inventors: Daniel Fleischer, Oakland, CA (US); Marko Jukic, San Francisco, CA (US); Andrew Thompson, Oakland, CA (US); Guido Radaelli, Oakland, CA (US)

(73) Assignee: Aurora Algae, Inc., Hayward, CA (US)

( * ) Notice: Subject to any disclaimer, the term of this patent is extended or adjusted under 35 U.S.C. 154(b) by 203 days.

This patent is subject to a terminal disclaimer.

(21) Appl. No.: 12/983,767

(22) Filed: Jan. 3, 2011

(65) Prior Publication Data

US 2011/0196163 A1 Aug. 11, 2011

Related U.S. Application Data

(63) Continuation-in-part of application No. 12/610,134, filed on Oct. 30, 2009, now Pat. No. 7,868,195.

(51) Int. Cl.
*C11B 1/00* (2006.01)

(52) U.S. Cl.
USPC ..... 554/21; 554/8; 554/20; 554/206

(58) Field of Classification Search
USPC ..... 554/8, 20, 21, 206
See application file for complete search history.

(56) References Cited

U.S. PATENT DOCUMENTS 1,926,780 A 9/1933 Lippincott
2,730,190 A 1/1956 Brown et al.
2,766,203 A 10/1956 Brown et al.
3,175,687 A 3/1965 Jones
3,468,057 A 9/1969 Buisson
3,897,000 A 7/1975 Mandt (Continued)

FOREIGN PATENT DOCUMENTS

JP 09-024362 A 1/1997
JP 2004300218 10/2004

(Continued)

OTHER PUBLICATIONS

Gouveia et al., "Microalgae as a raw material for biofuels production," J. Ind. Microbiol. Biotechnol, 2009, vol. 36, 269-274.

(Continued)

*Primary Examiner* — Deborah D Carr
(74) *Attorney, Agent, or Firm* — Carr & Ferrell LLP

(57) ABSTRACT

Exemplary methods include centrifuging a wet algal biomass to increase a solid content of the wet algal biomass to between approximately 10% and 40% to result in a centrifuged algal biomass, mixing the centrifuged algal biomass with an amphiphilic solvent to result in a mixture, heating the mixture to result in a dehydrated, defatted algal biomass, separating the amphiphilic solvent from the dehydrated, defatted algal biomass to result in amphiphilic solvent, water and lipids, evaporating the amphiphilic solvent from the water and the lipids, and separating the water from the lipids. The amphiphilic solvent may be selected from a group consisting of acetone, methanol, ethanol, isopropanol, butanone, dimethyl ether, and propionaldehyde. Other exemplary methods include filtering a wet algal biomass through a membrane to increase a solid content of the wet algal biomass to between approximately 10% and 40% to result in a filtered algal biomass.

20 Claims, 2 Drawing Sheets

(56) References Cited

U.S. PATENT DOCUMENTS

| | | | | |
|---|---|---|---|---|
| 3,962,466 | A | 6/1976 | Nakabayashi | |
| 4,003,337 | A | 1/1977 | Moore | |
| 4,159,944 | A | 7/1979 | Erickson et al. | |
| 4,253,271 | A | 3/1981 | Raymond | |
| 4,267,038 | A | 5/1981 | Thompson | |
| 4,341,038 | A | 7/1982 | Bloch et al. | |
| 4,365,938 | A | 12/1982 | Warinner | |
| 4,535,060 | A | 8/1985 | Comai | |
| 4,658,757 | A | 4/1987 | Cook | |
| 5,105,085 | A | 4/1992 | McGuire et al. | |
| 5,130,242 | A | 7/1992 | Barclay | |
| 5,180,499 | A | 1/1993 | Hinson et al. | |
| 5,244,921 | A | 9/1993 | Kyle et al. | |
| 5,275,732 | A | 1/1994 | Wang et al. | |
| 5,338,673 | A | 8/1994 | Thepenier et al. | |
| 5,478,208 | A | 12/1995 | Kasai | |
| 5,527,456 | A | 6/1996 | Jensen | |
| 5,539,133 | A | 7/1996 | Kohn et al. | |
| 5,567,732 | A | 10/1996 | Kyle et al. | |
| 5,658,767 | A | 8/1997 | Kyle | |
| 5,661,017 | A | 8/1997 | Dunahay et al. | |
| 5,668,298 | A | 9/1997 | Waldron | |
| 5,776,349 | A | 7/1998 | Guelcher et al. | |
| 6,117,313 | A | 9/2000 | Goldman | |
| 6,143,562 | A | 11/2000 | Trulson et al. | |
| 6,166,231 | A | 12/2000 | Hoeksema | |
| 6,372,460 | B1 * | 4/2002 | Gladue et al. | 435/134 |
| 6,524,486 | B2 | 2/2003 | Borodyanski et al. | |
| 6,579,714 | B1 | 6/2003 | Hirabayashi et al. | |
| 6,736,572 | B2 | 5/2004 | Geraghty | |
| 6,750,048 | B2 | 6/2004 | Ruecker et al. | |
| 6,768,015 | B1 | 7/2004 | Luxem et al. | |
| 6,831,040 | B1 | 12/2004 | Unkefer et al. | |
| 7,381,326 | B2 | 6/2008 | Haddas | |
| 7,582,784 | B2 | 9/2009 | Banavali et al. | |
| 7,767,837 | B2 | 8/2010 | Elliott | |
| 7,868,195 | B2 * | 1/2011 | Fleischer et al. | 554/20 |
| 7,883,882 | B2 | 2/2011 | Franklin et al. | |
| 8,404,473 | B2 | 3/2013 | Kilian et al. | |
| 2003/0199490 | A1 | 10/2003 | Antoni-Zimmermann et al. | |
| 2004/0121447 | A1 | 6/2004 | Fournier | |
| 2004/0161364 | A1 | 8/2004 | Carlson | |
| 2004/0262219 | A1 | 12/2004 | Jensen | |
| 2005/0048474 | A1 | 3/2005 | Amburgey, Jr. | |
| 2005/0064577 | A1 | 3/2005 | Berzin | |
| 2005/0164192 | A1 | 7/2005 | Graham et al. | |
| 2005/0170479 | A1 * | 8/2005 | Weaver et al. | 435/134 |
| 2005/0260553 | A1 | 11/2005 | Berzin | |
| 2005/0273885 | A1 | 12/2005 | Singh et al. | |
| 2006/0045750 | A1 | 3/2006 | Stiles | |
| 2006/0101535 | A1 | 5/2006 | Forster et al. | |
| 2006/0122410 | A1 * | 6/2006 | Fichtali et al. | 554/8 |
| 2006/0166243 | A1 | 7/2006 | Su et al. | |
| 2007/0102371 | A1 | 5/2007 | Bhalchandra et al. | |
| 2008/0118964 | A1 | 5/2008 | Huntley et al. | |
| 2008/0120749 | A1 | 5/2008 | Melis et al. | |
| 2008/0155888 | A1 | 7/2008 | Vick et al. | |
| 2008/0160591 | A1 | 7/2008 | Willson et al. | |
| 2008/0160593 | A1 | 7/2008 | Oyler | |
| 2008/0194029 | A1 | 8/2008 | Hegemann et al. | |
| 2008/0268302 | A1 | 10/2008 | McCall | |
| 2008/0275260 | A1 | 11/2008 | Elliott | |
| 2008/0293132 | A1 | 11/2008 | Goldman et al. | |
| 2009/0011492 | A1 | 1/2009 | Berzin | |
| 2009/0029445 | A1 | 1/2009 | Eckelberry et al. | |
| 2009/0081748 | A1 | 3/2009 | Oyler | |
| 2009/0148931 | A1 | 6/2009 | Wilkerson et al. | |
| 2009/0151241 | A1 | 6/2009 | Dressler et al. | |
| 2009/0162919 | A1 | 6/2009 | Radaelli et al. | |
| 2009/0234146 | A1 * | 9/2009 | Cooney et al. | 554/174 |
| 2009/0317857 | A1 | 12/2009 | Vick et al. | |
| 2009/0317878 | A1 | 12/2009 | Champagne et al. | |
| 2009/0317904 | A1 | 12/2009 | Vick et al. | |
| 2009/0325270 | A1 | 12/2009 | Vick et al. | |
| 2010/0022393 | A1 | 1/2010 | Vick | |
| 2010/0068772 | A1 | 3/2010 | Downey | |
| 2010/0151540 | A1 | 6/2010 | Gordon et al. | |
| 2010/0183744 | A1 | 7/2010 | Weissman et al. | |
| 2010/0196995 | A1 | 8/2010 | Weissman et al. | |
| 2010/0210003 | A1 | 8/2010 | King et al. | |
| 2010/0210832 | A1 | 8/2010 | Kilian et al. | |
| 2010/0260618 | A1 | 10/2010 | Parsheh et al. | |
| 2010/0261922 | A1 | 10/2010 | Fleischer et al. | |
| 2010/0314324 | A1 | 12/2010 | Rice et al. | |
| 2010/0317088 | A1 | 12/2010 | Radaelli et al. | |
| 2010/0327077 | A1 | 12/2010 | Parsheh et al. | |
| 2010/0330643 | A1 | 12/2010 | Kilian et al. | |
| 2010/0330658 | A1 | 12/2010 | Fleischer et al. | |
| 2011/0041386 | A1 | 2/2011 | Fleischer et al. | |
| 2011/0070639 | A1 | 3/2011 | Pandit et al. | |
| 2011/0072713 | A1 | 3/2011 | Fleischer et al. | |
| 2011/0136212 | A1 | 6/2011 | Parsheh et al. | |
| 2011/0196163 | A1 | 8/2011 | Fleischer et al. | |
| 2011/0197306 | A1 | 8/2011 | Bailey et al. | |
| 2011/0300568 | A1 | 12/2011 | Parsheh et al. | |
| 2011/0313181 | A1 | 12/2011 | Thompson et al. | |

FOREIGN PATENT DOCUMENTS

| | | | |
|---|---|---|---|
| JP | 2008280252 | | 11/2008 |
| WO | 2004106238 | A2 | 12/2001 |
| WO | 2009037683 | A1 | 3/2009 |
| WO | 2011053867 | A1 | 5/2011 |

OTHER PUBLICATIONS

Santin-Montanya, I. "Optimal Growth of Dunaliella Primolecta in Axenic Conditions to Assay Herbicides," Chemosphere, 66, Elsevier 2006, p. 1315-1322.

Felix, R. "Use of the cell wall-less alga Dunaliella bioculata in herbicide screening tests," Annals of Applied Biology, 113, 1988, pp. 55-60.

Janssen, M. "Phytosynthetic efficiency of Dunaliella tertiolecta under short light/dark cycles," Enzyme and Microbial Technology, 29, 2001, p. 298-305.

Saenz, M.E., "Effects of Technical Grade and a Commercial Formulation of Glyphosate on Algal Population Growth," Bulletin of Environmental Contamination Toxicology, 1997, 59: pates 638-644.

Endo et al. "Inactivation of Blasticidin S by Bacillus Cereus II. Isolation and Characterization of a Plasmid, pBSR 8, from Bacillus Cereus," The Journal of Antibiotics 41 (2): 271-2589-2601.

Hallmann et al., "Genetic Engineering of the Multicellular Green Alga Volvox: A Modified and Multiplied Bacterial Antibiotic Resistance Gene as a Dominant Selectable Marker" The Plant Journal 17(1): 99-109 (Jan. 1999).

Kindle et al. "Stable Nuclear Transformation of Chlamydomonas Using the Chlamydomonas Gene for Nitrate Reductase" The Journal of Cell Biology 109 (6, part 1): 2589-2601.

Prein et al. "A Novel Strategy for Constructing N-Terminal Chromosomal Fusions to Green Fluorescent Protein in the Yeast Saccharomyces cerevisiae" FEBS Letters 485 (2000) 29-34.

Schiedlmeier et al., "Nuclear Transformation of Volvox Carteri" Proceedings of the National Academy of Sciences USA 91(11): 5080-5084 (May 1994).

Wendland et al. "PCR-Based Methods Facilitate Targeted Gene Manipulations and Cloning Procedures" Curr.Gen. (2003) 44:115-123.

Molnar et al., "Highly Specific Gene Silencing by Artificial MicroRNAs in the Unicellular Agla Chlamydomonas reinhardtii," Plant Jour. ePub Jan. 17, 2009, vol. 58, No. 1, pp. 157-164 (Abstract Only).

Chen et al., "Conditional Production of a Functional Fish Growth Hormone in the Transgenic Line of Nannochloropsis oculata (*Eustigmatophyceae*)," J. Phycol. Jun. 2008, vol. 44, No. 3, pp. 768-776.

Nelson et al., "Targeted Disruption of NIT8 Gene in Chlamydomonas reinhardtii." Mol. Cell. Bio. Oct. 1995, vol. 15, No. 10, pp. 5762-5769.

(56) References Cited

OTHER PUBLICATIONS

Grima et al. "Recovery of Microalgal Biomass in Metabolites: Process Options and Economics," Biotechnology Advances 20, 2003, pp. 491-515.
Knuckey et al. "Production of Microalgal Concentrates by Flocculation and their Assessment as Aquaculture Feeds," Aquacultural Engineering 35, 2006, pp. 300-313.
Kureshy et al., "Effect of Ozone Treatment on Cultures of *Nannochloropsis oculata, Isochrysis galbana*, and *Chaetoceros gracilis*," Journal of the World Aquaculture Society, 1999, 30(4), pp. 473-480.
Csogor et al., "Light Distribution in a Novel Photobioreactor -Modelling for Optimization," Journal of Applied Phycology, vol. 13, pp. 325-333.
Janssen et al., "Enclosed Outdoor Photobioreactors: Light Regime, Photosynthetic Efficiency, Scale-Up, and Future Prospects," Biotechnology and Bioengineering, vol. 81, No. 2, pp. 193-210, Jan. 2003.
Zittelli et al., "Mass Cultivation of *Nannochloropsis Sp*. In Annular Reactors," Journal of Applied Phycology, vol. 15, pp. 107-113, Mar. 2003.
Strzepek et al., "Photosynthetic Architecture Differs in Coastal and Oceanic Diatoms," Nature, vol. 431, pp. 689-692, Oct. 2004.
Lee et al., "Isolation and Characterization of a Xanthophyll Aberrant Mutant of the Green Alga *Nannochloropsis oculata*," Marine Biotechnology, 2006, vol. 8, pp. 238-245.
NCBI entry EE109892 (Jul. 2006) [Retrieved from the Internet on Oct. 19, 2009, <http://www.ncbi.nlm.nih.gov/ nucest/ EE109892?ordinalops=1&itool=EntrezSystem2.Pentrez.Sequence. Sequence_ResultsPanel.Sequence_RVDocSum>].
Berberoglu et al., "Radiation Characteristics of *Chlamydomonas reinhardtii* CC125 and its truncated chlorophyll antenna transformants tla1, tlaX, and tla1-CW+," International Journal of Hydrogen Energy, 2008, vol. 33, pp. 6467-6483.
Ghirardi et al., "Photochemical Apparatus Organization in the Thylakoid Membrane of Hordeum vulgare wild type and chlorophyll b-less chlorina f2 mutant," Biochimica et Biophysica Act (BBA)—Bioengergetics, vol. 851, Issue 3, Oct. 1986, pp. 331-339 (abstract only).
Steinitz et al., "A mutant of the cyanobacterium Plectonema boryanum resistant to photooxidation," Plant Science Letters, vol. 16, Issues 2-3, 1979, pp. 327-335 (abstract only).
Koller et al., "Light Intensity During Leaf Growth Affects Chlorophyll Concentration and CO2 Assimilation of a Soybean Chlorophyll Mutant," Crop Science, 1974, vol. 14, pp. 779-782 (abstract only).
Shikanai et al., "Identification and Characterization of Arabidopsis Mutants with Reduced Quenching of Chlorophyll Fluorescence," Plant and Cell Physiology, 1999, vol. 40, No. 11, pp. 1134-1142 (abstract only).
Hedenskog, G. et al., "Investigation of Some Methods for Increasing the Digestibility in Vitro of Microalgae," Biotechnology and Bioengineering, vol. Xi, pp. 37-51, 1969.
Loury, "Method for Rapid Conversion of Fats to Methyl Esters," Revue Francaise des Corps Gras, 1967, 14(6), 383-389 (abstract only).
Cravotto et al., "Improved Extraction of Vegetable Oils under high-intensity Ultrasound and/or Microwaves," Ultrasonics Sonochemistry, 15: 898-902, 2008.
Ben-Amotz, Ami. "Large-Scale Open Algae Ponds," presented at the NREL-AFOSR Joint Workshop on Algal Oil for Get Fuel Production in Feb. 2008.
Ebeling et al., "Design and Operation of a Zero-Exchange Mixed-Cell Raceway Production System," 2nd Int'l Sustainable Marine Fish Culture Conference and Workshop, Oct. 2005.
Ebeling et al., "Mixed-Cell Raceway: Engineering Design Criteria, Construction, and Hydraulic Characterization," North American Journal of Aquaculture, 2005, 67: 193-201 (abstract only).
Labatut et al., "Hydrodynamics of a Large-Scale Mixed-Cell Raceway (MCR): Experimental Studies," Aquacultural Engineering vol. 37, Issue 2, Sep. 2007, pp. 132-143.
Kizilisoley et al., "Micro-Algae Growth Technology Systems," Presented by Selim Helacioglu, Soley Institute, 2008.
Dunstan et al., "Changes in the Lipid Composition and Maximisation of the Polyunsaturated Fatty Acid Content of Three Microalgae Grown in Mass Culture," Journal of Applied Phycology, 5, pp. 71-83, 1993.
Carvalheiro et al., "Hemicellulose Biorefineries: A Review on Biomass Pretreatments," Journal of Scientific & Industrial Research, vol. 67, Nov. 2008, pp. 849-864.
Lotero et al., "Synthesis of Biodiesel via Acid Catalysis," Ind. Eng. Chem. Res., 2005, pp. 5353-5363.
International Search Report and Written Opinion of the International Searching Authority mailed Jan. 6, 2011 for Application No. PCT/US2010/054861, filed Oct. 29, 2010.
Chen et al., "Subcritical co-solvents extraction of lipid from wet microalgae pastes of *Nannochloropsis sp*.," Eur. J. Lipid Sci. Technol., vol. 114, 2012, pp. 205-212.
Wang et al., "Lipid and Biomass Distribution and Recovery from Two Microalgae by Aqueous and Alcohol Processing," Journal of the American Oil Chemists' Society, vol. 38, Issue 2, Jul. 2011, pp. 335-345.
Pitipanapong et al., "New approach for extraction of charantin from Momordica charantia with pressurized liquid extraction," Separation and Purification Technology, vol. 52, Issue 3, Jan. 2007.
Examination Report mailed Aug. 15, 2013 in Australian Application No. 2010313246 filed Oct. 29, 2010.

* cited by examiner

SYSTEMS AND METHODS FOR EXTRACTING LIPIDS FROM AND DEHYDRATING WET ALGAL BIOMASS

CROSS-REFERENCE TO RELATED APPLICATIONS

The present continuation-in-part application claims the priority and benefit of U.S. patent application Ser. No. 12/610,134, filed on Oct. 30, 2009, which issued on Jan. 11, 2011 as U.S. Pat. No. 7,868,195, titled "Systems and Methods for Extracting Lipids from and Dehydrating Wet Algal Biomass," which is hereby incorporated by reference.

BACKGROUND OF THE INVENTION

1. Field of the Invention

Embodiments of the present invention relate to extracting lipids from and dehydrating wet algal biomass.

2. Description of Related Art

Microalgae differentiate themselves from other single-cell microorganisms in their natural ability to accumulate large amounts of lipids. Because most lipidic compounds have the potential to generate biofuels and renewable energy, there is a need for systems and methods for extracting lipids from and dehydrating wet algal biomass.

SUMMARY OF THE INVENTION

Exemplary methods include centrifuging a wet algal biomass to increase a solid content of the wet algal biomass to between approximately 10% and 40% to result in a centrifuged algal biomass, mixing the centrifuged algal biomass with an amphiphilic solvent to result in a mixture, heating the mixture to result in a dehydrated, defatted algal biomass, separating the amphiphilic solvent from the dehydrated, defatted algal biomass to result in amphiphilic solvent, water and lipids, evaporating the amphiphilic solvent from the water and the lipids, and separating the water from the lipids. The amphiphilic solvent may be selected from a group consisting of acetone, methanol, ethanol, isopropanol, butanone, dimethyl ether, and propionaldehyde. According to a further embodiment, the mixture may be heated in a pressurized reactor, which may be a batch or a continuous pressurized reactor. The mixture may be heated with microwaves, ultrasound, steam, or hot oil. The amphiphilic solvent may be separated from the dehydrated, defatted algal biomass via membrane filtration, centrifugation, and/or decanting to result in amphiphilic solvent, water and lipids.

Other exemplary methods include filtering a wet algal biomass through a membrane to increase a solid content of the wet algal biomass to between approximately 10% and 40% to result in a filtered algal biomass, mixing the filtered algal biomass with an amphiphilic solvent to result in a mixture, heating the mixture to result in a dehydrated, defatted algal biomass, separating the amphiphilic solvent from the dehydrated, defatted algal biomass to result in amphiphilic solvent, water and lipids, evaporating the amphiphilic solvent from the water and the lipids, and separating the water from the lipids. According to a further exemplary embodiment, the wet algal biomass may be filtered to increase the solid content to approximately 30%.

DETAILED DESCRIPTION

According to various exemplary systems and methods, wet microalgal biomass is simultaneously defatted and dehydrated by extraction with an amphiphilic solvent. The microalgal biomass (70% to 90% water) is contacted with an amphiphilic solvent such as liquid dimethyl ether or acetone and heated (50 degrees C. to 150 degrees C.) with vigorous mixing under pressure (5 bar to 30 bar). The solids (carbohydrates and proteins) are separated from the liquid (solvent, water and dissolved lipids) by membrane filtration, decantation or centrifugation. The liquid portion is then distilled to recover the solvent, leaving behind crude lipids and water, which are separated by their density difference. The crude lipids may be transesterified into biodiesel. The solid portion is heated to recover traces of solvent, resulting in a dry, defatted biomass product.

Figure 1:
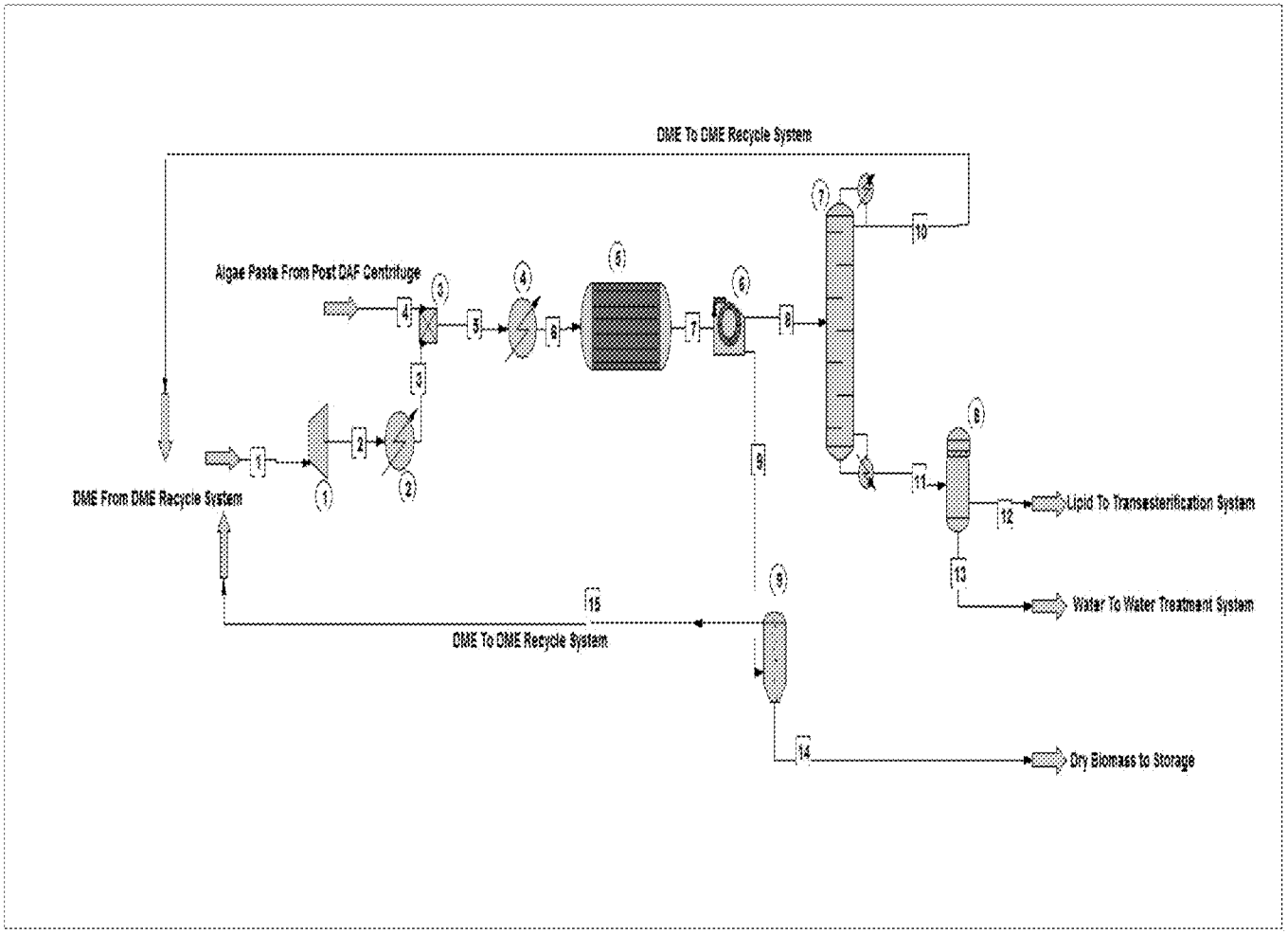
FIG. 1 shows a system for extracting lipids from and dehydrating wet algal biomass according to one exemplary embodiment.

FIG. 1 shows a system for extracting lipids from and dehydrating wet algal biomass, according to one exemplary embodiment. The exemplary system comprises a compressor (1), a first heat exchanger (2), a mixer (3), a second heat exchanger (4), a reactor system (5), a solids remover (6), a distillation unit (7), a phase separation station (8), and a dryer (9). According to various exemplary embodiments, the compressor (1) compresses the dimethyl ether to a liquid. The first heat exchanger (2) cools the compressed dimethyl ether (in liquid form). The mixer (3) mixes the dimethyl ether and algae paste. The second heat exchanger (4) adjusts the temperature of the dimethyl ether and algae paste mixture. The reactor system (5) extracts the lipids and dewaters the algae cells. The solids remover (6) separates the defatted and dewatered biomass from the liquid. The distillation unit (7) removes the dimethyl ether. The phase separation station (8) separates the oil from the water. The dryer (9) removes residual dimethyl ether from the biomass.

In another exemplary embodiment, the mixer (3) mixes a biomass with the dimethyl ether. Solvents other than dimethyl ether may be used. Desirable alternative solvents should allow for the effective dissolving of both lipids and water, and should be efficiently distilled from the water. Such alternative amphiphilic solvents may include without limitation, acetone, methanol, ethanol, isopropanol, butanone, propionaldehyde, and other similar solvents. The mixture is pumped through the reactor system (5) at a suitable temperature, pressure and residence time. The reactor system (5) receives pressure from compressor (1) and heat from the second heat exchanger (4). The reactor may be batch, continuous, counter-current, co-current, cascading multistage or another type of heated, pressurized liquid mixing system. The second heat exchanger (4) may include, but is not limited to microwaves, ultrasound, convection, steam, hot vapor, induction, electrical resistive heating element, etc. Alternatively, the biomass may be mixed with the dimethyl ether in a continuous, heated and pressurized counter-current liquid-liquid extractor.

The mixture is then passed through the solids remover (6), which may comprise a membrane filtration system, a centrifuge and/or a decanter. The solids are collected and sent to a solvent recovery unit (unit 9 in FIG. 1). The filtrate or supernatant is transferred to the distillation unit (7), for flash evaporation or distillation that recovers the dimethyl ether. The remaining water and lipid mixture may be separated at the phase separation station (8), which may comprise an oil separator. Alternatively, the remaining water and lipid mixture may be sent to a liquid-liquid extractor to extract the lipids with hexane which may be sent to an evaporator to yield the lipids.

Figure 2:
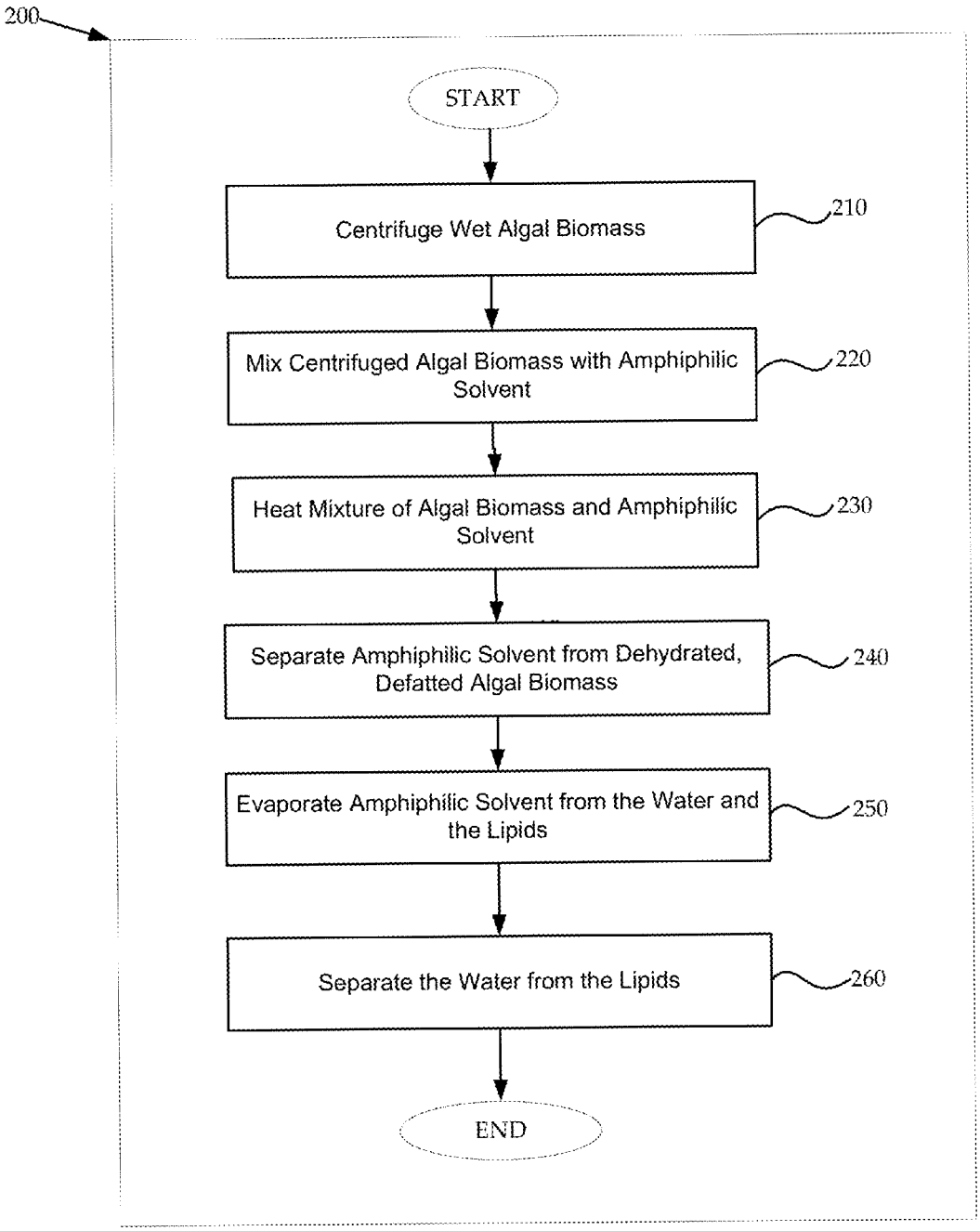
FIG. 2 is a diagram showing an exemplary method for extracting lipids from and dehydrating wet algal biomass.

FIG. 2 is a diagram showing an exemplary method 200 for extracting lipids from and dehydrating wet algal biomass.

At step 210, wet algal biomass is centrifuged to increase its solid content to a range of approximately ten percent (10%) to forty percent (40%). According to another exemplary embodiment, membrane filtration is used instead of centrifugation.

At step 220, the centrifuged algal biomass is mixed with an amphiphilic solvent to result in a mixture. According to one exemplary embodiment, solvents other than dimethyl ether may be used. Desirable alternative solvents should allow for the effective dissolving of both lipids and water, and should be efficiently distilled from the water. Such alternative amphiphilic solvents may include without limitation, acetone, methanol, ethanol, isopropanol, butanone, propionaldehyde, and other similar solvents.

At step 230, the mixture is heated to result in a dehydrated, defatted algal biomass. In various exemplary embodiments, the mixture is pumped through the reactor system (5) (FIG. 1) at a suitable temperature, pressure and residence time. The reactor system (5) receives pressure from compressor (1) (FIG. 1) and heat from the second heat exchanger (4) (FIG. 1). The reactor may be batch, continuous, counter-current, co-current, cascading multistage or another type of heated, pressurized liquid mixing system. The second heat exchanger (4) may include, but is not limited to microwaves, ultrasound, convection, steam, hot vapor, induction, electrical resistive heating element, etc. Alternatively, the biomass may be mixed with the dimethyl ether in a continuous, heated and pressurized counter-current liquid-liquid extractor.

At step 240, the amphiphilic solvent is separated from the dehydrated, defatted algal biomass to result in amphiphilic solvent, water, and lipids. According to one exemplary embodiment, the mixture is passed through the solids remover (6) (FIG. 1), which may comprise a membrane filtration system, a centrifuge, and/or a decanter. The solids are collected and sent to a solvent recovery unit (9) (FIG. 1).

At step 250, the amphiphilic solvent is evaporated from the water and the lipids. In various exemplary embodiments, the filtrate or supernatant is transferred to the distillation unit (7) (FIG. 1), for flash evaporation or distillation that recovers the dimethyl ether.

At step 260, the water is separated from the lipids. According to various exemplary embodiments, the remaining water and lipid mixture may be separated at the phase separation station (8) (FIG. 1), which may comprise an oil separator. Alternatively, the remaining water and lipid mixture may be sent to a liquid-liquid extractor to extract the lipids with hexane which may be sent to an evaporator to yield the lipids.

EXAMPLE ONE 250 grams of microalgal biomass paste of 80% water content is mixed with 250 g of dimethyl ether in a sealed 2 liter pressure vessel. The vessel is pressurized to 135 psi with nitrogen. The vessel is then heated with vigorous stirring for 30 minutes at 80 degrees C. The contents of the vessel are then siphoned into a pressurized membrane filtration system with the filtrate passing into an evaporator. The retentate is put back in the pressure vessel and mixed with an additional 250 g of dimethyl ether, and the vessel again stirred under 100 psi nitrogen at 80 degrees C. for 30 minutes. After membrane filtration, the second filtrate is sent to the evaporator, and the dimethyl ether distilled at atmospheric pressure and recovered by condensation. What remains is water with a layer of lipids floating on top. These can be extracted twice with 20 mls of hexane, which is then evaporated under a stream of nitrogen to yield the lipids. The retentate can be easily dried of dimethyl ether under a gentle stream of nitrogen to yield the defatted, dehydrated biomass.

EXAMPLE TWO 1 gram of microalgal biomass paste of 80% water content is mixed with 1 ml of acetone and sealed in a 15 ml test tube. The tube is then heated for 20 minutes at 80 degrees C. The tube is then centrifuged for 5 minutes at 2300 RCF and the supernatant decanted into another tube. To the pellet is added an additional 1 ml of acetone, and the tube sealed and heated at 80 degrees C. for another 20 minutes. After centrifugation, the combined supernatants are evaporated under a stream of nitrogen at 37 degrees C. What remains is water with a layer of lipids floating on top. These can be extracted twice with 2 mls of hexane, which is then evaporated under a stream of nitrogen to yield the lipids. The pellet can be easily dried of acetone under a gentle stream of nitrogen to yield the defatted, dehydrated biomass.

EXAMPLE THREE 10 grams of *Nannochloropsis* paste of 85% water content is mixed with 20 grams of liquefied dimethyl ether in a sealed 75 milliliter pressure vessel. The mixture is heated at 80 C with vigorous stirring for 30 minutes. Pressure is maintained to keep the mixture in a liquid state. Stirring is stopped, and the mixture forms 2 layers, a top layer consisting of dimethyl ether, algal lipids and water, and a bottom layer of algae biomass (with some residual water, dimethyl ether, and lipids). The top layer is decanted while maintaining sufficient pressure to keep the dimethyl ether in a liquid state. The bottom layer is extracted 3 more times as above with fresh liquid dimethyl ether. The dimethyl ether in the pooled decanted top layers is evaporated at room temperature to yield algae lipids and water. The bottom layer is gently air dried to yield a defatted, dehydrated algae biomass. The algae lipids are extracted from the water with 1 milliliter of hexane.

EXAMPLE FOUR 10 grams of *Nannochloropsis* paste of 85% water content is mixed with 20 grams of liquefied dimethyl ether in a sealed 75 milliliter pressure vessel. The mixture is heated at 135 C with vigorous stirring for 30 minutes. Pressure is maintained to keep the dimethyl ether in a supercritical state. Stirring is stopped and the mixture allowed to cool under-pressure to 40 C, with pressure maintained to keep the dimethyl ether in a liquid state. The mixture forms 2 layers, a top layer consisting of liquid dimethyl ether, algal lipids and water, and a bottom layer of algae biomass (with some residual water, dimethyl ether and lipids). The top layer is decanted while maintaining sufficient pressure to keep the dimethyl ether in a liquid state. The bottom layer is extracted 3 more times as above with fresh liquid dimethyl ether. The dimethyl ether in the pooled decanted top layers is evaporated at room temperature to yield algae lipids and water. The bottom layer is gently air dried to yield a defatted, dehydrated algae biomass. The algae lipids are extracted from the water with 1 milliliter of hexane.

EXAMPLE FIVE 15 grams of *Nannochloropsis* paste of 85% water content is mixed with 15 milliliters of acetone in a sealed 75 milliliter pressure vessel. The mixture is heated at 80 C with vigorous stirring for 30 minutes. Pressure is maintained to keep the acetone in a liquid state. Stirring is stopped and the mixture allowed to cool under-pressure to 40 C, with pressure maintained to keep the acetone in a liquid state. The mixture is allowed sit until it forms 2 layers, a top layer consisting of acetone, algal lipids and water, and a bottom layer of algae biomass solids (with some entrained water, acetone and lipids). The top layer is decanted while maintaining sufficient pressure to keep the acetone in a liquid state. The bottom layer is extracted 2 more times as above with fresh acetone. The acetone in the pooled decanted top layers is evaporated at room temperature to yield algae lipids and water. The bottom layer is gently air dried to yield a defatted, dehydrated algae biomass. The algae lipids are extracted from the water with 1.5 milliliters of hexane.

EXAMPLE SIX 10 grams of *Cyclotella* paste containing 80% water is placed in a 75 milliliter pressure vessel along with 10 grams of hollow ceramic lysis-enhancing beads (1 millimeter diameter) and 20 grams liquefied dimethyl ether. Pressure is used to maintain the dimethyl ether in a liquid state. The mixture is stirred at ambient temperature for 30 minutes. The mixture is then allowed to settle for 1 hour, at which point 2 layers form, a bottom layer containing algal solids, and a top layer containing dimethyl ether, dissolved water, dissolved lipids, and floating lysis-enhancing beads. The top layer is decanted at pressure sufficient to maintain the dimethyl ether in a liquid state. This is passed through a screen filter to recover the beads, which are added back to the bottom layer along with 20 grams of fresh liquefied dimethyl ether. The mixture is again stirred for 30 minutes. Then the mixture is allowed to settle for 1 hour at which point 2 layers form, a bottom layer containing algal solids, and a top layer containing dimethyl ether, dissolved water, dissolved lipids, and floating lysis-enhancing beads. The top layer is decanted at pressure sufficient to maintain the dimethyl ether in a liquid state. This is passed through a screen filter to recover the beads, which are added back to the bottom layer along with 20 grams of fresh liquefied dimethyl ether. The mixture is again stirred for 30 minutes and settled and separated as above, with the top layer being decanted through a screen to recover the beads. The 3 pooled top layers containing dimethyl ether, dissolved water and dissolved lipids are gently distilled to recover the dimethyl ether, leaving behind a mixture of water and lipids. This mixture is allowed to settle and the floating lipids layer is decanted from the heavier water layer. The remaining dehydrated, defatted algae solids are gently air dried to remove residual dimethyl ether.

While various embodiments have been described herein, it should be understood that they have been presented by way of example only, and not limitation. Thus, the breadth and scope of a preferred embodiment should not be limited by any of the herein-described exemplary embodiments.

The invention claimed is:

1. A method comprising:

mixing algal biomass with an amphiphilic solvent;

separating the amphiphilic solvent from algal solids, or from any part of the algal biomass not dissolved in the amphiphilic solvent, to result in amphiphilic solvent, water and lipids;

evaporating most or substantially all of the amphiphilic solvent from the water and the lipids, to result in a mixture of the water and the lipids; and separating the lipids from the mixture.

2. The method of claim 1, wherein the amphiphilic solvent is selected from a group consisting of acetone, methanol, ethanol, isopropanol, butanone, dimethyl ether, and propionaldehyde.

3. A method comprising:

filtering a wet algal biomass through a membrane to increase a solid content of the wet algal biomass to between approximately 10% and 40% to result in a filtered algal biomass;

mixing the filtered algal biomass with an amphiphilic solvent to result in a mixture;

heating the mixture to result in a dehydrated, defatted algal biomass;

separating the amphiphilic solvent from the dehydrated, defatted algal biomass to result in amphiphilic solvent, water and lipids;

evaporating the amphiphilic solvent from the water and the lipids; and separating the water from the lipids.

4. The method of claim 3, wherein the wet algal biomass is filtered to increase the solid content to approximately 30%.

5. The method of claim 3, wherein the amphiphilic solvent is selected from a group consisting of acetone, methanol, ethanol, isopropanol, butanone, dimethyl ether, and propionaldehyde.

6. The method of claim 3, wherein the mixture is heated in a pressurized reactor.

7. The method of claim 6, wherein the pressurized reactor is a batch or a continuous pressurized reactor.

8. The method of claim 3, wherein the mixture is heated with microwaves, ultrasound, steam, or hot oil.

9. The method of claim 3, wherein the amphiphilic solvent is separated from the dehydrated, defatted algal biomass via membrane filtration to result in amphiphilic solvent, water and lipids.

10. The method of claim 3, wherein the amphiphilic solvent is separated from the dehydrated, defatted algal biomass via centrifugation to result in amphiphilic solvent, water and lipids.

11. The method of claim 3, wherein the separating includes decanting the amphiphilic solvent from the dehydrated, defatted algal biomass to result in amphiphilic solvent, water and lipids.

12. The method of claim 3, wherein the separating of the water from the lipids includes adding a nonpolar solvent.

13. The method of claim 12, wherein the nonpolar solvent is propane, butane, pentane, hexane, butene, propene, naphtha or gasoline.

14. The method of claim 3, wherein the separating of the water from the lipids includes decanting the lipids without a nonpolar solvent.

15. The method of claim 3, wherein the separating of the water from the lipids includes adding a nonpolar solvent in a continuous liquid-liquid extractor.

16. The method of claim 15, wherein the nonpolar solvent is evaporated from the lipids by distillation or flash evaporation.

17. The method of claim 3, wherein the separating of the water from the lipids includes adding a nonpolar solvent in a batch vessel and decanting the batch vessel.

18. The method of claim 17, wherein the nonpolar solvent is evaporated from the lipids by distillation or flash evaporation.

19. The method of claim 3, wherein the wet algal biomass is centrifuged to increase the solid content to approximately 30%.

20. The method of claim 3, wherein the evaporating the amphiphilic solvent from the water and the lipids is performed by flash evaporation, distillation or by pervaporation.

* * * * *